US005517294A

United States Patent [19]

Ogiri et al.

[11] Patent Number: 5,517,294

[45] Date of Patent: May 14, 1996

[54] IMAGE-FORMING MACHINE EQUIPPED WITH CLEANING MEANS

[75] Inventors: Tadakazu Ogiri; Kiyonori Yamamoto; Masahiko Kobayashi; Naoki Motobayashi; Hiroshi Ishida, all of Osaka, Japan

[73] Assignee: Mita Industrial Co., Ltd, Osaka, Japan

[21] Appl. No.: 520,398

[22] Filed: Aug. 29, 1995

[30] Foreign Application Priority Data

Sep. 21, 1994 [JP] Japan ..... 6-254272

[51] Int. Cl.[6] ..... G03G 21/00

[52] U.S. Cl. ..... 355/299

[58] Field of Search ..... 355/296, 299

[56] References Cited

U.S. PATENT DOCUMENTS

| | | | |
|---|---|---|---|
| 4,334,766 | 6/1982 | Sugiyama et al. | 355/299 |
| 4,498,760 | 2/1985 | Sugiyama | 355/299 |
| 4,947,216 | 8/1990 | Surti | 355/299 |
| 5,321,483 | 6/1994 | Yokoyama et al. | 355/299 |
| 5,438,400 | 8/1995 | Kuribayashi et al. | 355/299 |

*Primary Examiner*—Joan H. Pendegrass
*Assistant Examiner*—Sophia S. Chen
*Attorney, Agent, or Firm*—Beveridge, DeGrandi, Weilacher & Young

[57] ABSTRACT

An image-forming machine comprising a rotary drum and a cleaning means which removes the toner remaining on the peripheral surface of the rotary drum. The cleaning means includes a support member that extends in the direction of center axis of the rotary drum, a blade-holding member that is mounted on the upper surface of the support member and extends in the direction of center axis of the rotary drum, and a cleaning blade that is held by the blade-holding means and extends in the direction of center axis of the rotary drum. The blade-holding member is allowed to swing on the swing axis that extends in a plane which is substantially perpendicular to the center axis of the rotary drum. An acute angle α is defined between the cleaning blade and a tangential line of the drum at a portion where the front end of the cleaning blade that is pushed comes into contact with the peripheral surface of the rotary drum, on the downstream side as viewed in a direction in which the rotary drum rotates. Restriction members are attached to the support member at both ends thereof in the direction of the center axis, the restriction members having restriction portions opposed, while maintaining a very small gap x, to the upper surface of the blade-holding member in order to restrict both ends of the blade-holding member in the direction of center axis from being displaced in a direction to separate away from the upper surface of the support member.

4 Claims, 2 Drawing Sheets

IMAGE-FORMING MACHINE EQUIPPED WITH CLEANING MEANS

FIELD OF THE INVENTION

The present invention relates to an image-forming machine equipped with a cleaning means that removes toner remaining on the peripheral surface of a rotary drum. More specifically, the invention relates to an image-forming machine equipped with a cleaning means including a cleaning blade that is pushed onto the peripheral surface of the rotary drum.

DESCRIPTION OF THE PRIOR ART

An image-forming machine such as an electrostatic copying machine or an electrostatic printer is equipped with a rotary drum which has an electrostatic photosensitive material disposed on the peripheral surface thereof. The rotary drum is surrounded by an electrostatic latent image-forming zone, a developing zone, a transfer zone and a cleaning zone arranged in this order as viewed in a direction in which the rotary drum rotates. In the electrostatic latent image-forming zone, the electrostatic photosensitive material is uniformly charged and then, is selectively discharged upon the irradiation with light, so that electrostatic latent image is formed thereon. In the developing zone, the electrostatic latent image is developed into a toner image by such developing means as magnetic brush developing means. In the transfer zone, the toner image on the electrostatic photosensitive material is transferred onto a sheet material which may be a common paper. The toner image transferred onto the sheet material is fixed on the sheet member by a fixing means such as the one of the heated and pressurized type, and a copied or printed paper is obtained. In the cleaning zone, the toner remaining on the electrostatic photosensitive material is removed.

In a typical example of the cleaning means, the cleaning means comprises a support member disposed extending in the direction of center axis of the rotary drum, and a blade-support member mounted on the upper surface of the support member to extend in the direction of center axis of the rotary drum. The blade-support member is swingingly mounted at its intermediate portion in the direction of center axis of the rotary drum so as to swing on a swing axis that extends in a plane which is substantially perpendicular to the center axis of the rotary drum. On the blade support member is held a cleaning blade which is preferably made of a synthetic rubber. The cleaning blade extends in the direction of center axis of the rotary drum and its front end is pushed onto the peripheral surface of the rotary drum. The cleaning blade is disposed at a so-called counter position with respect to the rotary drum, i.e., disposed in a manner that an acute angle $\alpha$ is defined between a cleaning blade and a tangential line of the rotary drum at a portion where the front end of the cleaning blade comes into contact with the peripheral surface of the rotary drum, on the downstream side as viewed in a direction in which the rotary drum rotates.

In the above-mentioned cleaning means, the blade-holding member is allowed to swing on a swing axis that extends in a plane substantially perpendicularly to the center axis of the rotary drum and, hence, the cleaning blade held by the blade-holding member swings on the swing axis that extends in a plane substantially perpendicularly to the center axis of the rotary drum. It is therefore presumed that the front end of the cleaning blade extends substantially in parallel with the center axis of the rotary drum and is pushed onto the peripheral surface of the rotary drum sufficiently uniformly over the whole width of the rotary drum. However, the present inventors have found through their experience that the pushing force of the front end of the cleaning blade exerted upon the peripheral surface of the rotary drum becomes relatively small toward both ends of the rotary drum, causing the cleaning performance to become defective at both ends of the rotary drum and often causing the toner to be adhered in a form of dot or dash mark on the peripheral surface of the drum at both ends thereof.

SUMMARY OF THE INVENTION

The principal object of the present invention is to provide an improved image-forming machine in which the cleaning blade is pushed onto the peripheral surface of the rotary drum sufficiently uniformly over the whole width of the rotary drum, reliably preventing the cleaning performance from becoming poor toward both end portions of the rotary drum.

The present inventors have keenly conducted experiments and analysis concerning a conventional image-forming machine equipped with the abovementioned cleaning means, and have recognized that the cleaning performance becomes defective in the conventional image-forming machine toward both end portions of the rotary drum due to a phenomenon that is described below. That is, the cleaning blade is disposed at the counter position with respect to the rotary drum. When the rotary drum is rotated, therefore, a considerably large force is exerted on the cleaning blade from the rotary drum in a direction of separating the cleaning blade from the peripheral surface of the rotary drum. The blade-support member supporting the cleaning blade is swingingly mounted, at its intermediate portion in the direction of center axis of the rotary drum, on the support member, and extends from the intermediate portion toward its both ends in a so-called cantilevered manner. Accordingly, the blade-holding member is resiliently deformed by the considerably large force that is transmitted from the rotary drum to the blade-holding member via the cleaning blade, and both ends of the blade-holding member is displaced to a considerable degree in a direction to separate away from the upper surface of the support member. Hence, the pushing force at the front end of the cleaning blade upon the peripheral surface of the rotary drum becomes relatively small toward both ends of the rotary drum, so that the cleaning performance becomes defective.

Based upon the recognition of the above-mentioned phenomenon in the conventional imageforming machine, the above-mentioned principal object of the present invention is accomplished by attaching restriction members to the support member at both ends thereof in the direction of center axis of the rotary drum, so that restriction portions of the restriction members restrict the blade-holding member from being displaced in a direction to separate away from the upper surface of the support member at both ends in the direction of center axis of the rotary drum.

That is, according to the present invention, the above-mentioned principal object is accomplished by providing an image-forming machine comprising a rotary drum which is rotatably mounted and has an electrostatic photosensitive material disposed on the peripheral surface thereof, and a cleaning means which removes the toner remaining on the peripheral surface of the rotary drum in a cleaning zone, said cleaning means including a support member that extends in the direction of center axis of the rotary drum, a blade-holding member that is mounted on the upper surface of the support member and extends in the direction of center axis of the rotary drum, and a cleaning blade that is held by the blade-holding means and extends in the direction of center axis of the rotary drum, said blade-holding member being mounted on the upper surface of the support member by coupling its intermediate portion in the direction of center axis to the upper surface of the support member to swing on the swing axis that extends in a plane which is substantially perpendicular to the center axis of the rotary drum, the front end of the cleaning blade being pushed onto the peripheral surface of the rotary drum, and the tangential line of the rotary drum at a portion where the front end of the cleaning blade is contacted to the peripheral surface of the rotary drum and the cleaning blade defining an acute angle a on the downstream side as viewed in a direction in which the rotary drum rotates, wherein restriction members are attached to the support member at both ends thereof in the direction of center axis, the restriction members having restriction portions opposed, while maintaining a very small gap x, to the upper surface of the blade-holding member in order to restrict both ends of the blade-holding member in the direction of center axis from being displaced in a direction to separate away from the upper surface of the support member.

It is desired that the gap x is 0.2 mm$\leqq$x $\leqq$0.4 mm. In a preferred embodiment, the blade-holding member is made of a steel plate having nearly an L-shape in cross section with a first leg and a second leg which are nearly perpendicular to each other, the first leg of the blade-holding member extends along the upper surface of the support member, the second leg of the blade-holding member protrudes from the first leg toward the rotary drum, and the cleaning blade is fastened at its base end to the second leg of the blade-holding member. It is desired that the support member is made of a steel plate having a channel shape in cross section, and the restriction members are made of a steel piece, respectively.

In the image-forming machine of the present invention, both ends of the blade-holding member are restricted by the action of the restriction members from being displaced in a direction to separate away from the upper surface of the support member. Thus, it is allowed to effectively prevent the pushing force of the front end of the cleaning blade acting upon the peripheral surface of the rotary drum from decreasing, making it possible to fully reliably prevent the cleaning performance from becoming defective. Restriction portions of the restriction members are separated away from the blade-holding member at a very small gap x until both ends of the blade-holding member are displaced to some extent in a direction to separate away from the upper surface of the support member and come into contact with the restriction portions of the restriction members. Accordingly, the blade-holding member and the cleaning blade mounted thereon are allowed to freely swing on a swing axis that extends in a plane which is substantially perpendicular to the center axis of the rotary drum and, hence, parallel relationship is inevitably compensated between the peripheral surface of the rotary drum and the front end of the cleaning blade.

In order to prevent both ends of the blade-holding member from being displaced in a direction to separate away from the upper surface of the support member, it can be contrived to form the blade-holding member using a highly rigid member such as a considerably thick steel plate. This, however, results in an increase in the cost of production and in the weight and size of the cleaning device. It can be also contrived to prevent displacement at both ends of the blade-holding member by fixing both ends of the blade-holding member to the upper surface of the support member. In this case, however, the blade-holding member is prevented from swinging on the swing axis that extends in a plane substantially perpendicular to the center axis of the rotary drum and, hence, the tolerance in the production or in the mounting is not compensated in parallel relationship between the peripheral surface of the rotary drum and the front end of the cleaning blade, and consequently, it becomes difficult to push the front end of the cleaning blade onto the peripheral surface of the rotary drum sufficiently uniformly over the whole width of the rotary drum.

DETAILED DESCRIPTION OF THE PREFERRED EMBODIMENTS

A preferred embodiment of the image-forming machine constituted according to the present invention will now be described in detail with reference to the accompanying drawings.

Figure 1:
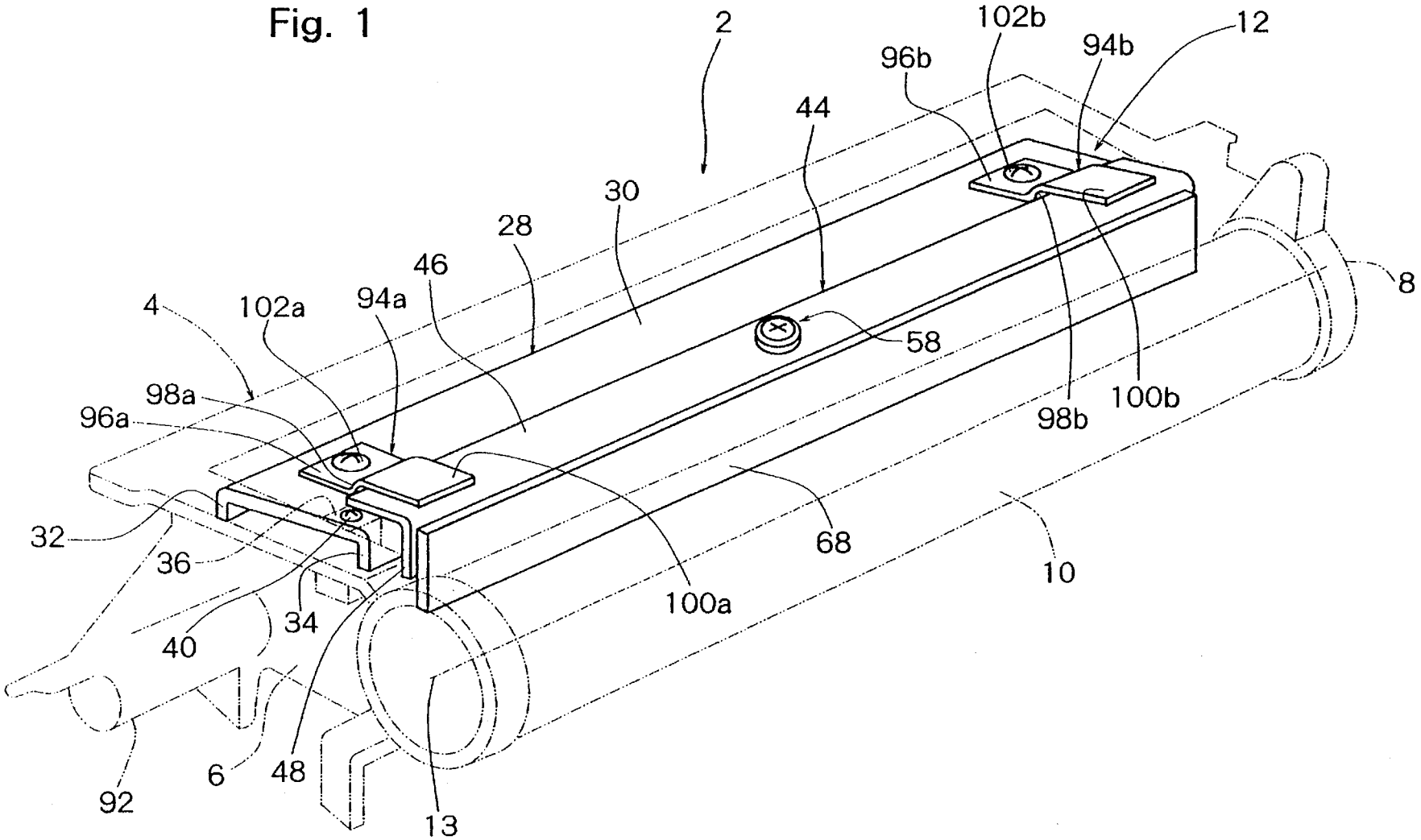
FIG. 1 is a perspective view illustrating a unit equipped with a rotary drum and a cleaning means in an image-forming machine constituted according to the present invention.
Figure 2:
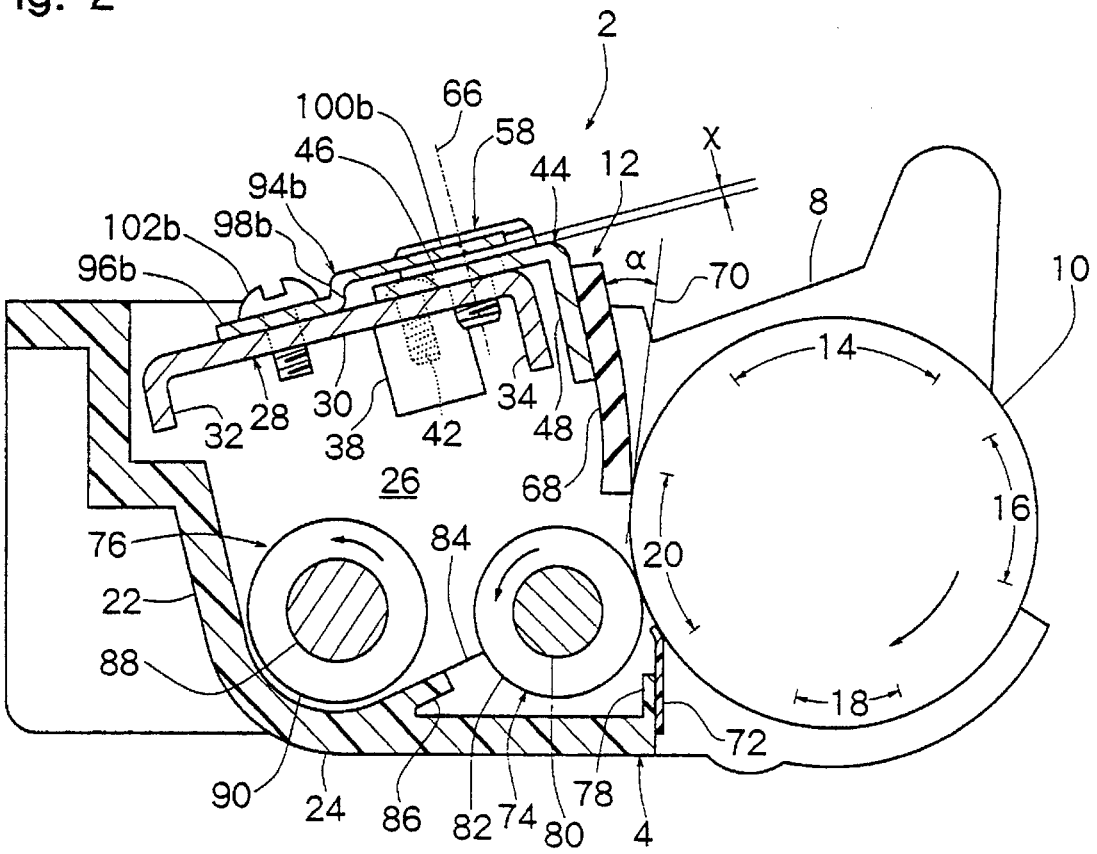
FIG. 2 is a sectional view of a unit shown in FIG. 1.

FIGS. 1 and 2 illustrate a unit 2 mounted on a predetermined position in a housing (not shown) of an image-forming machine. Such a unit 2 includes a unit frame 4 that is desirably made of a suitable synthetic resin as a unitary structure. The unit frame 4 has a front end wall 6 and a rear end wall 8 disposed at a predetermined distance from one another in the direction of width (direction perpendicular to the surface of the paper in FIG. 2). A rotary drum 10 and a cleaning means 12 are disposed between the front end wall 6 and the rear end wall 8.

The rotary drum 10 is disposed between the front end wall 6 and the rear end wall 8 of the unit frame 4 being allowed to rotate. The center axis 13 of the rotary drum 10 extends substantially horizontally. On the peripheral surface of the rotary drum 10 is disposed a suitable electrostatic photosensitive material such as an organic photosemiconductor. The rear end of a support shaft (not shown) of the rotary drum 10 protrudes rearwardly penetrating through the rear end wall 8, and an input gear (not shown) is fitted to the rear end of the support shaft. When the unit 2 is mounted on the predetermined position in the housing, the rotary drum 10 is coupled, via the input gear, to a rotary drive source (not shown) which may be an electric motor. Being driven by the rotary drive source, the rotary drum 10 is rotated in the clockwise direction as indicated by arrow in FIG. 2. As clearly shown in FIG. 2, the rotary drum 10 is surrounded by an electrostatic latent image-forming zone 14, a developing zone 16, a transfer zone 18 and a cleaning zone 20 in this order as viewed in a direction in which the rotary drum 10 rotates. In the electrostatic latent image-forming zone 14, the peripheral surface of the rotary drum 10 is uniformly charged to a predetermined polarity by a suitable charging means (not shown) such as a DC corona discharger. Next, the peripheral surface of the rotary drum 10 is irradiated with light from an appropriate optical means (not shown) selectively in accordance with image that is to be formed and is discharged. Thus, electrostatic latent image is formed on the peripheral surface of the rotary drum 10. In the developing zone 16, the toner is applied to the peripheral surface of the rotary drum 10 by a suitable developing means (not shown) such as magnetic brush developing means, and the electrostatic latent image is developed into toner image. Then, in the transfer zone 18, a transfer member (not shown) which may be a common paper is brought into intimate contact with the peripheral surface of the rotary drum 10, and the toner image on the rotary drum 10 is transferred onto the transfer member. The transfer member is peeled off the rotary drum 10, fed to a fixing means (not shown), and the toner image on the transfer member is fixed by the action of the fixing means. In the cleaning zone 20, the toner remaining on the peripheral surface of the rotary drum 10 after the transfer operation is removed by the action of the cleaning means 12.

With further reference to FIGS. 1 and 2, a side wall 22 and a bottom wall 24 extending in the direction of width (in the direction perpendicularly to the surface of the paper in FIG. 2) are disposed between the front end wall 6 and the rear end wall 8 of the unit frame 4. The side wall 22 and the bottom wall 24 are connected to each other to define a cleaning chamber 26. At an upper part of the cleaning chamber 26 is disposed a support member 28 extending in the direction of center axis of the rotary drum 10 (in the direction perpendicularly to the surface of the paper in FIG. 2). It is desired that the support member 28 is made of a steel plate having a thickness of about 1.6 mm, and has a flat main portion 30 of a channel-like shape in cross section and hanging portions 32 and 34 that hang down from both side edges of the main portion 30. A support block 36 (FIG. 1) that rearwardly protrudes is formed at a rear upper end portion of the front end wall 6 of the unit frame 4, and a support block 38 (FIG. 2) that forwardly protrudes is formed at a front upper end portion of the rear end wall 8 of the unit frame 4. The support member 28 is placed at its both ends on the support blocks 36 and 38, and fastening screws 40 (FIG. 1) and 42 (FIG. 2) are screwed into the support blocks 36 and 38 passing through the holes (not shown) formed in the abovementioned both ends, so that the support member 28 is secured to the unit frame 4. A blade-holding member 44 is mounted on the upper surface of the support member 28 extending in the direction of center axis of the rotary drum 10 (in the direction perpendicularly to the surface of the paper in FIG. 2). It is desired that the blade-holding member 44 is made of a steel plate having a thickness of about 1.2 mm, has an L-shape in cross section, and has a first leg 46 and a second leg 48. The first leg 46 of the blade-holding member 44 extends along the upper surface of the main portion of the support member 28, and the second leg 48 downwardly extends toward the rotary drum 10 from one side edge (right side edge in FIG. 2) of the first leg 46. The size in the direction of width of the blade support member 44 (size in the direction of center axis of the rotary drum 10) is slightly smaller than the size in the direction of width of the support member 28 (size in the direction of center axis of the rotary drum 10), and the first leg 46 of the blade support member 44 is located between the fastening screws 40 and 42 for fastening the support member 28.

Figure 3:
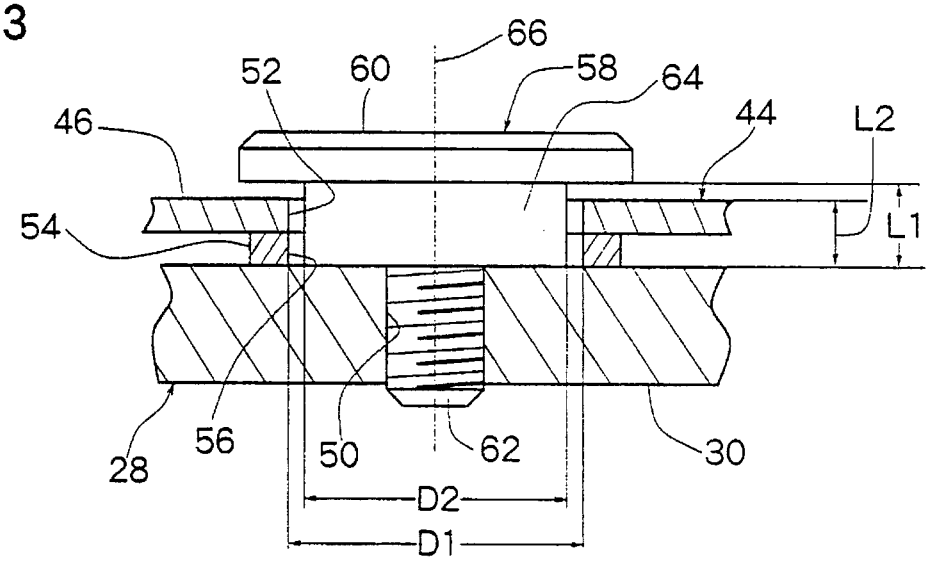
FIG. 3 is a partial sectional view illustrating a manner of swingingly mounting a blade-holding member in the cleaning means in the unit shown in FIG. 1.

Described below with reference to FIGS. 1 and 2 together with FIG. 3 is the manner of mounting the blade-holding member 44 on the support member 28. A threaded hole 50 is formed in the main portion 30 of the support member 28 at an intermediate portion in the direction of center axis of the rotary drum 10, and a circular opening 52 is formed in the first leg 46 of the blade-holding member 44 at an intermediate portion in the direction of center axis of the rotary drum 10. An annular shim 54 having a circular opening 56 is interposed between the main portion 30 of the support member 28 and the first leg 46 of the blade-holding member 44. A mounting bolt 58 is screwed into the threaded hole 50 formed in the main portion 30 of the support member 28 passing through the circular opening 52 formed in the first leg 46 of the blade-holding member 44 and through the circular opening 56 of the annular shim 54. The mounting bolt 58 has a head portion 60, a threaded shaft portion 62 and a support shaft portion 64 positioned therebetween. The inner diameter D1 of the circular openings 52 and 56 is smaller than the outer diameter of the head portion 60 of the mounting bolt 58, but is slightly larger than the outer diameter D2 of the support shaft portion 64 by, for example, about 0.05 mm. Furthermore, the length L1 of the support shaft portion 64 of the mounting bolt 58 in the direction of axis is slightly larger, by, for example, about 0.1 to 0.2 mm, than the size L2 which consists of the thickness of the first leg 46 of the blade-holding member 44 and the thickness of the annular shim 54. Therefore, the blade-holding member 44 is allowed to swing on the center axis 66 of the mounting bolt 58 as a swing center axis. The center axis 66 of the mounting bolt 58, i.e., the swing center axis of the blade-holding member 44 extends in a plane which is substantially perpendicular to the center axis 13 of the rotary drum 10.

With reference to FIGS. 1 and 2, a cleaning blade 68 that extends in the direction of center axis of the rotary drum 10 (in the direction perpendicularly to the surface of the paper in FIG. 2) is held on the outer surface of the second leg 48 (right surface in FIG. 2) of the blade-holding member 44. The cleaning blade 68 is made of a synthetic rubber such as an urethane rubber having a thickness of about 2 mm, and is attached at its base end, i.e., at its upper end to the outer surface of the second leg 48 of the blade-holding member 44 via a suitable adhesive agent or a double-sided adhesive tape. The cleaning blade 68 downwardly protrudes beyond the second leg 48 of the blade-holding member 44, and is pushed at its front end onto the peripheral surface of the rotary drum 10. The cleaning blade 68 is disposed at a counter position, and an acute angle a of from about 10 to about 30 degrees is defined between the cleaning blade 68 and the tangential line 70 of the rotary drum 10 at a portion where the front end of the cleaning blade 68 comes into contact with the peripheral surface of the rotary drum 10, on the downstream side in a direction in which the rotary drum 10 rotates. As described above, the blade-holding member 44 swings on a swing axis (i.e., center axis 66) that extends in a plane which is substantially perpendicular to the center axis 13 of the rotary drum 10 and, hence, the cleaning blade 68 held by the blade-holding member 44 swings on the swing axis (i.e., center axis 66) that extends in a plane substantially perpendicularly to the center axis 13 of the rotary drum 10. Accordingly, the cleaning blade 68 swings, as required, on the swing axis and is automatically set to extend in parallel with the center axis 13 of the rotary drum 10 with sufficient precision.

In the illustrated cleaning means 12 are further disposed a sealing means 72, a toner-recovering means 74 and a toner conveyer means 76. The sealing means 72 can be made of a flexible sheet member such as polyethylene terephthalate sheet that extends in the direction of center axis of the rotary drum 10. An upwardly protruding auxiliary wall 78 is formed at the free side edge (right side edge in FIG. 2) of the bottom wall 24 of the unit frame 4, and the lower end of the sheet member constituting the sealing means 72 is attached to the outer surface of the auxiliary wall 78. The upper end of the sheet member constituting the sealing means 72 is brought into intimate contact with the peripheral surface of the rotary drum 10. The toner-recovering means 74 includes a rotary shaft 80 which is rotatably mounted between the front end wall 6 and the rear end wall 8 of the unit frame 4, and a recovery roller 82 fitted onto the rotary shaft 80. The recovery roller 82 can be made of a sponge. The toner-recovering means 74 is further provided with a scraping member 84. The scraping member 84 which can be made of a suitable plastic sheet protrudes toward the recovery roller 82 from its base end attached to a protruded wall 86 formed on the bottom wall 24, and its front edge is brought into contact with the recovery roller 82. The toner conveyer means 76 includes a rotary shaft 88 which is rotatably mounted between the front end wall 6 and the rear end wall 8 of the unit frame 4, and spiral vanes 90 disposed on the outer peripheral surface of the rotary shaft 88. The rotary shaft 80 of the toner-recovering means 74 and the rotary shaft 88 of the toner conveyer means 76 rearwardly protrude penetrating through the rear end wall 8 of the unit frame 4, and are coupled to the above-mentioned input gear (not shown) fitted to the rear end of the support shaft of the rotary drum 10 via transmission gears (not shown). As the rotary drum 10 is rotated in the clockwise direction in FIG. 2, the recovery roller 82 is rotated in the counterclockwise direction in FIG. 2, and the spiral vanes 90 are rotated in the counterclockwise direction, too, in FIG. 2. Moreover, as schematically shown in FIG. 1, a toner-discharge cylinder 92 forwardly protruded is formed on the front end wall 6 of the unit frame 4 in relation to the spiral vanes 90.

The description is further continued with reference to FIGS. 1 and 2. In the image-forming machine constituted according to the present invention, it is important that the cleaning means 12 is provided with a pair of restriction members 94*a* and 94*b*. The restriction members 94*a* and 94*b* have flat base portions 96*a* and 96*b*, connection portions 98*a* and 98*b* that extend nearly vertically relative to the base portions 96*a* and 96*b*, and restriction portions 100*a* and 100*b* that extend substantially in parallel with the base portions 96*a* and 96*b*. The restriction members 94*a* and 94*b* can be made of a steel plate having a thickness of about 1.2 mm. As will be clearly understood from FIG. 1, the restriction members 94*a* and 94*b* are mounted on both end portions of the support member 28. In further detail, the restriction member 94*a* is positioned on the front end portion of main portion 30 of the support member 28, and is fastened onto the support member 28 by screwing a fastening screw 102*a* into the support member 28 passing through a hole (not shown) formed in the base portion 96*a* thereof, and the restriction member 94*b* is positioned on the rear end portion of main portion 30 of the support member 28, and is fastened onto the support member 28 by screwing a fastening screw 102*b* into the support member 28 passing through a hole (not shown) formed in the base portion 96*b* thereof. The restriction portion 100*a* of the restriction member 94*a* is positioned being opposed, while maintaining a very small gap x, to the upper surface of the front end of the first leg 46 of the blade-holding member 44, and the restriction portion 100*b* of the restriction member 94*b* is positioned being opposed, maintaining a very small gap x, to the upper surface of the rear end of the first leg 46 of the blade-holding member 4. It is desired that the above-mentioned very small gap x is from 0.2 to 0.4 mm (i.e., $0.2\ \text{mm} \leqq x \leqq 0.4\ \text{mm}$). When the very small gap x is set to be too small, the blade-holding member 44 may be hindered from swinging on the center axis 66 of the mounting bolt 58 due to tolerance in the production or in the mounting. When the above-mentioned very small gap x becomes too great, it becomes difficult to restrict displacement at both ends of the blade-holding member 44 to a sufficiently small value as will become obvious from the description mentioned later.

Briefly described below is the function of the above-mentioned cleaning means 12. In the cleaning zone 20, the front end of the cleaning blade 68 is pushed onto the peripheral surface of the rotary drum 10 that rotates in the clockwise direction in FIG. 2, and the residual toner falls down from the peripheral surface of the rotary drum 10 due to the action of the cleaning blade 68. The toner that fell is leftwardly, in FIG. 2, carried by the peripheral surface of the recovery roller 82 that rotates counterclockwise in FIG. 2, scraped off the peripheral surface of the recovery roller 82 by the action of the scraping member 84, and is guided onto the spiral vanes 90. Then, by the action of the spiral vanes 90 that are rotating in the counterclockwise direction in FIG. 2, the toner is conveyed to a front portion of the cleaning chamber 26. The toner conveyed to the front portion of the cleaning chamber 26 is discharged from the cleaning chamber 26 through the toner-discharge cylinder 92 formed on the front end wall 6 of the unit frame 4. The toner discharged from the cleaning chamber 26 is recovered in a suitable container (not shown) and is discarded or is used again being returned back to the developing means (not shown).

As will be easily comprehended with reference to FIG. 2, furthermore, the cleaning blade 68 is disposed at a so-called counter position with respect to the rotary drum 10 and, hence, a considerably large upwardly directed force is given to the cleaning blade 68 and to the blade-holding member 44 that is holding the cleaning blade 68 by the rotary drum 10 which rotates in the clockwise direction in FIG. 2. As described with reference to FIG. 3, the length L1 in the axial direction of the support shaft 64 of the mounting bolt 58 mounting the blade-holding member 44 on the support member 28 is greater, by a small amount which may be from about 0.1 to about 0.2 mm, than the size L2 which consists of the thickness of the first leg 46 of the blade-holding member 44 and the thickness of the annular shim 54. Due to the force exerted from the rotary drum 10 to the cleaning blade 68, therefore, the cleaning blade 68 and the blade-holding member 44 as a whole are upwardly moved by the above small amount. Moreover, the blade-holding member 44 is coupled only at its intermediate portion in the direction of center axis of the rotary drum 10 to the support member 28 via the mounting bolt 58, and extends in a so-called cantilevered manner forwardly and rearwardly from the intermediate portion. Therefore, the blade-holding member 44 is elastically deformed to some extent, and the front end and the rear end thereof are upwardly displaced. As the blade-holding member 44 is so elastically deformed, the front end and the rear end of the blade-holding member 44 come into contact with the restriction portions 100*a* and 100*b* of the restriction members 94*a* and 94*b*. Thus, the rigidity of the blade-holding member 44 as well as the rigidity of the restriction members 94*a* and 94*b* resist against resilient deformation of the blade-holding member 44. The so-called cantilevered length of the restriction portions 100*a* and 100*b* of the restriction members 94*a* and 94*b* are relatively short and, hence, the restriction portions 100*a* and 100*b* of the restriction members 94*a* and 94*b* exhibit sufficiently large resistance against the above-mentioned resilient deformation of the blade-holding member 44. Accordingly, as the front end and the rear end of the blade-holding member 44 come into contact with the limiting portions 100*a* and 100*b* of the restriction members 94*a* and 94*b*, the blade-holding member 44 is effectively prevented from being further resiliently deformed, and, hence, the front end and rear end of the blade-holding member 44 are effectively prevented from being further upwardly displaced, i.e., the font end and rear end of the cleaning blade 68 are effectively prevented from being further upwardly displaced. Thus, both ends of the cleaning blade 68 are prevented from excessively displaced upwards, and cleaning performance is reliably prevented from being deteriorated since the pushing force of the cleaning blade 68 onto the peripheral surface of the rotary drum 10 is not so much decreased at both ends of the cleaning blade 68.

As the rotary drum 10 is clockwisely rotated in FIG. 2, as described above, the cleaning blade 68 and the blade-holding member 44 as a whole are upwardly moved by a small amount and, then, the blade-holding member 44 is resiliently deformed to some extent, so that the front end and the rear end thereof are upwardly displaced. As desired, the restriction members 94*a* and 94*b*, blade-holding member 44 and cleaning blade 68 can be designed in such sizes that the front end of the cleaning blade 68 pushes the peripheral surface of the rotary drum 10 sufficiently uniformly and with a given value over the whole width in the direction of center axis of the rotary drum 10 in a state where the cleaning blade 68 and the blade-holding member 44 are displaced as described above.

According to the above-mentioned cleaning means 12, the support member 28 on which the blade-holding member 44 is mounted is fixingly secured to a predetermined position. As desired, however, the support member 28 may be mounted to swing on the swing axis which is substantially in parallel with the center axis 13 of the rotary drum 10 and a suitable positioning means such as an electromagnetic solenoid may be mounted on the support member 28. In such a case, the support member 28 is selectively brought to an acting position to push the front end of the cleaning blade 68 onto the peripheral surface of the rotary drum 10 only when the peripheral surface of the rotary drum 10 needs be cleaned, and the support member 28 is brought to a non-acting position so that the front end of the cleaning blade 68 is separated away from the peripheral surface of the rotary drum 10 when the peripheral surface of the rotary drum 10 needs not be cleaned.

What we claim is:

1. An image-forming machine comprising a rotary drum which is rotatably mounted and has an electrostatic photosensitive material disposed on the peripheral surface thereof, and a cleaning means which removes the toner remaining on the peripheral surface of the rotary drum in a cleaning zone, said cleaning means including a support member that extends in the direction of center axis of the rotary drum, a blade-holding member that is mounted on the upper surface of the support member and extends in the direction of center axis of the rotary drum, and a cleaning blade that is held by the blade-holding means and extends in the direction of center axis of the rotary drum, said blade-holding member being mounted on the upper surface of the support member by coupling its intermediate portion in the direction of center axis to the upper surface of the support member to swing on the swing axis that extends in a plane which is substantially perpendicular to the center axis of the rotary drum, the front end of the cleaning blade being pushed onto the peripheral surface of the rotary drum, and the tangential line of the rotary drum at a portion where the front end of the cleaning blade is contacted to the peripheral surface of the rotary drum and the cleaning blade defining an acute angle $\alpha$ on the downstream side as viewed in a direction in which the rotary drum rotates, wherein restriction members are attached to the support member at both ends thereof in the direction of center axis, the restriction members having restriction portions opposed, while maintaining a very small gap x, to the upper surface of the blade-holding member in order to restrict both ends of the blade-holding member in the direction of center axis from being displaced in a direction to separate away from the upper surface of the support member.

2. An image-forming machine according to claim 1, wherein said gap x is $0.2\ \text{mm} \leqq x \leqq 0.4\ \text{mm}$.

3. An image-forming machine according to claim 1, wherein said blade-holding member is made of a steel plate having nearly an L-shape in cross section with a first leg and a second leg which are nearly perpendicular to each other, the first leg of the blade-holding member extends along the upper surface of the support member, the second leg of the blade-holding member protrudes from the first leg toward the rotary drum, and the cleaning blade is fixed at its base end to the second leg of the blade-holding member.

4. An image-forming machine according to claim 1, wherein said support member is made of a steel plate having a channel shape in cross section, and the restriction members are made of a steel piece, respectively.

* * * * *